United States Patent [19]

Wallick, Jr. et al.

[11] Patent Number: 4,834,216

[45] Date of Patent: May 30, 1989

[54] FOLDABLE LADDER STRUCTURE AND METHOD OF MANUFACTURING THE SAME

[75] Inventors: Claude R. Wallick, Jr.; Thomas J. Schmitt, both of Louisville, Ky.

[73] Assignee: Emerson Electric Co., St. Louis, Mo.

[21] Appl. No.: 3,613

[22] Filed: Jan. 15, 1987

[51] Int. Cl.[4] ..... E06C 1/383

[52] U.S. Cl. ..... 182/165; 182/152; 182/180; 182/46; 182/104

[58] Field of Search ..... 182/165–177, 182/152, 156, 159, 46, 104, 180, 21–26, 118, 194; D25/62–65

[56] References Cited

U.S. PATENT DOCUMENTS

| | | | |
|---|---|---|---|
| 178,345 | 6/1876 | Stockton | 182/165 |
| D. 243,019 | 1/1977 | Confer | D25/64 |
| 579,437 | 3/1897 | Knisell | 182/118 X |
| 628,624 | 7/1899 | Grace | 182/173 |
| 650,006 | 5/1900 | Haas | 182/176 |
| 1,194,025 | 8/1916 | Jones | 182/165 |
| 2,294,333 | 8/1942 | Fay | 182/176 |
| 3,487,889 | 1/1970 | Horowitz | 182/46 |
| 4,023,647 | 5/1977 | Confer | 182/46 X |
| 4,029,172 | 6/1977 | Green | 182/194 X |
| 4,124,093 | 11/1978 | Breisch | 182/46 X |
| 4,228,872 | 10/1980 | Treitz | 182/194 |
| 4,383,488 | 5/1983 | Macho | 182/46 X |

*Primary Examiner*—Alvin C. Chin-Shue

*Attorney, Agent, or Firm*—Polster, Polster and Lucchesi

[57] ABSTRACT

Foldable ladder structure and method of making the same wherein plastic material is injected and expanded in molds to form several parts of a foldable ladder which includes front and rear ladder sections that can be pivotally hinged at their upper portions, a collapsible shelf and spreader linkage to allow the sections to be relatively pivoted from collapsed face-to-face relation to erected position.

22 Claims, 4 Drawing Sheets

FOLDABLE LADDER STRUCTURE AND METHOD OF MANUFACTURING THE SAME

BACKGROUND OF THE INVENTION

The present invention relates to an improved foldable ladder structure and a method of manufacturing such foldable ladder structure and more particularly to a structure wherein at least one or more of several sections of a foldable ladder are formed from a shaped, integral and unitary structural material and to a method of forming such sections.

It is well known in the ladder art to make principal ladder sections of a complete ladder, such as the front step section and the rear back section, the support shelf and the spreakder linkage from wood, aluminum, fiberglass or even plastic materials. It also is well known to assemble these several sections into a completed ladder wherein the sections can be moved relative to one another between a foldable or collapsed position wherein the front and rear sections are in adjacent face-to-face relation for transport and storage to an erected position wherein the lower portions of the front and rear sections are spaced apart with a spreader mechanism interposed between and connected to the front and rear sections serving to limit the spread or angle of opening and with a shelf connected to the upper part of one of the spread apart sections extended to support material thereon. The manufacture and assembly of the various and multiple parts of past ladders has been comparatively complex and difficult, requiring the separate cutting, sawing and finishing of numerous parts such as steps, braces, side rails, shelves, spreader arms, linkage mechanisms, hinges, wear treads, and trusses and gussets required to strengthen the several parts wherever needed. Further, the assembly of these numerous parts including but not limited to the steps of cutting, drilling, sanding, aligning, holding, bolting, nailing, gluing and otherwise fastening one part to another has been time and labor consuming, resulting in labor intensive products which have been comparatively expensive in manufacture and assembly, heavy for transport and bulky for storage.

One of several patents which illustrate past types of ladder structures is U.S. Pat. No. 821,391, issued to S. E. Wiltse on May 22, 1986, which broadly discloses hinged collapsible, erectable step members. In addition, a number of prior patents broadly suggest making one or more parts from plastic materials, such as can be seen in U.S. Pat. No. 3,042,140, issued to G. E. Basile et al on July 3, 1962; No. 3,744,591, issued to R. Lucci et al on July 10, 1973; No. 4,023,647, issued to R. C. Confer on May 17, 1977; No. 4,029,172, issued to A. Green on June 14, 1977; No. 4,124,093, issued to J. H. Breisch on Nov. 7, 1978; No. 4,193,476, issued to J. D. Emmons on Mar. 18, 1980; No. 4,215,766, issued to R. D. Littlefield et al on Aug. 5, 1980; and No. 4,244,760, issued to E. C. Smith on Jan. 13, 1981. As aforediscussed, the ladder structures as taught by these patents as well as other prior structures have been accompanied with undesirably complex and expensive manufacturing and assembly problems due to the number of parts involved and the number of assembly steps required.

The present invention (the novel designs for which are disclosed in copending design patent applications: Ser. No. D.710,479, filed Mar. 11, 1985; Ser. No. D.851,683, filed Apr. 14, 1986; and, Ser. No. D.852,500, filed Apr. 14, 1986) provides a unique ladder structure and a method of making the same which requires a minimum of sections to reduce manufacturing and assembly steps, which can be comparatively light in weight and compact for transport and storage but which is sturdy and of sufficient strength and stability to meet various industry standards and which is, at the same time, both electrically insulative and resistant to moisture and other weathering elements. The unique and novel apparatus and method of the present invention not only limits the number of parts required for efficient and economical manufacture but includes assembly features which allow for ready alignment and interchangeability and user features which allow for ready and sturdy erection, collapse, transport and storage, offering the required strength and stability with minimum wear and weather erosion.

Various other features of the present invention will become obvious to one skilled in the art upon reading the disclosure set forth herein.

SUMMARY OF THE INVENTION

More particularly, the present invention provides foldable ladder structure comprising: opposed front and rear ladder sections, each including a pair of spaced longitudinally extending side members with spaced cross-brace means connectively extending therebetween with the brace means of at least one section being in the form of a spaced top platform and steps extending normal to and connected to the spaced side members, at least one of the sections including at least a portion of the top platform being formed from a shaped, integral and unitary structural material; and, hinge means for pivotally connecting the front and rear ladder sections together at the upper portions thereof so that the sections can be pivoted relative each other from collapsed face-to-face relation to erected position with the upper portions in proximal relation and the lower portions in spaced distal relation. In addition, the present invention provides a novel, unitary and integral shelf section and a novel link arm structure for a spreader section. Further, the present invention provides a novel method for forming ladder sections for foldable ladder structure comprising the steps of: supply a controlled quantity of expansible plastic compound in unexpanded form along a partially confined first mold part of a mold pair, the first mold part of the pair having a preselected shape in accordance with the ladder section to be formed, the first mold part of the mold pair being confined with an opposing second and mating mold part of the pair also of preselected shape in accordance with the ladder section to be formed; expanding the compound to the limits of confinement of the mating pair of mold parts; and, releasing the finished ladder section from mold confinement after the expanded plastic compound has set.

It is to be understood that various changes can be made by one skilled in the art in the several parts of the apparatus disclosed herein and in the several steps of the method described herein without departing from the scope or spirit of the invention.

BRIEF DESCRIPTION OF THE DRAWINGS

Referring to the drawings which disclose an advantageous embodiment of the structure of the present invention and a schematic flow diagram of the inventive method.

DETAILED DESCRIPTION OF THE DRAWINGS

Figure 1:
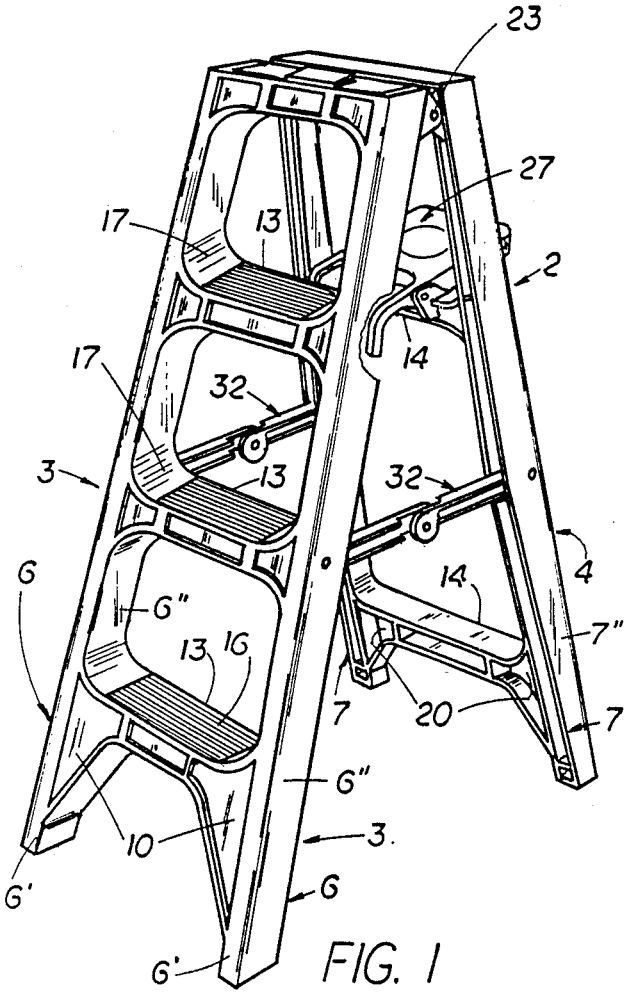
FIG. 1 is a front perspective view of the inventive foldable ladder in erected position, looking downwardly thereon.
Figure 3:
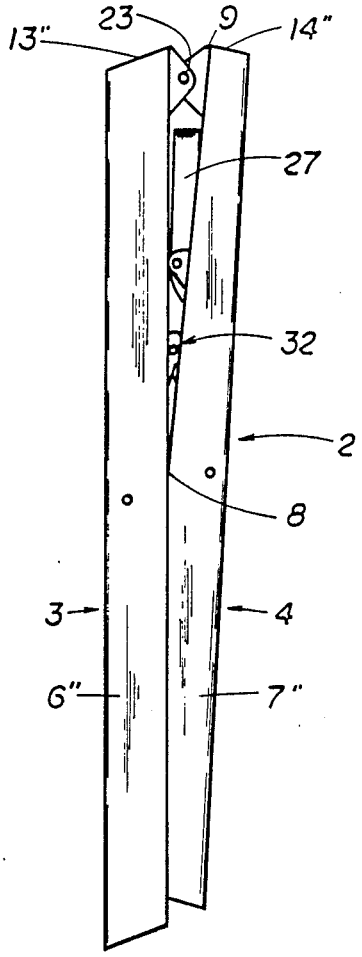
FIG. 3 is a right side elevational view of the foldable ladder in fully folded or collapsed position.
Figure 2:
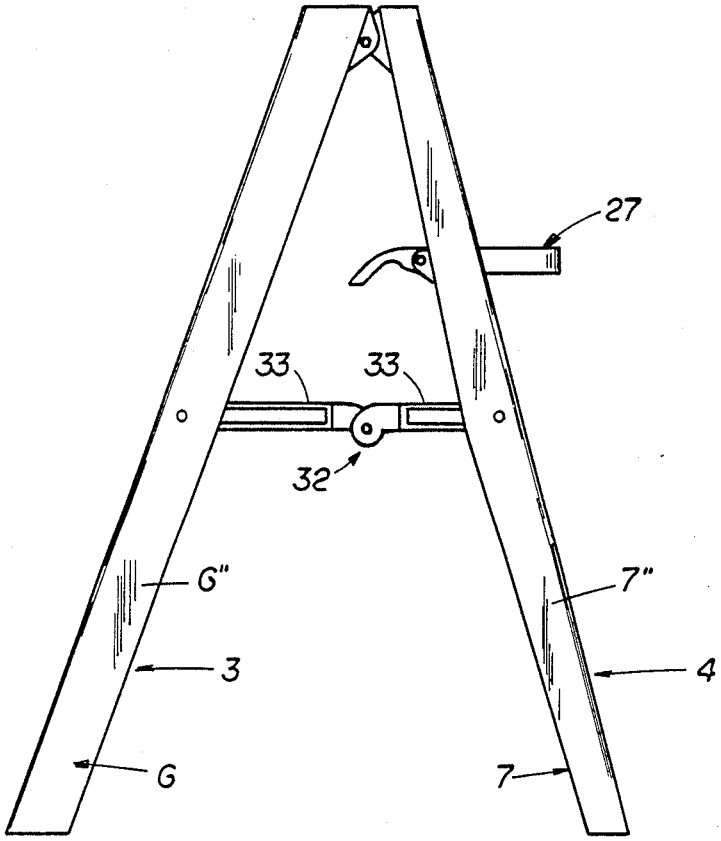
FIG. 2 is a right side elevational view of FIG. 1.

Referring to FIGS. 1–3 of the drawings, the novel foldable ladder structure broadly referred to by reference numeral 2, includes opposed front ladder section 3 and rear ladder section 4. Advantageously, each of the ladder sections as described hereinafter can be formed from a shaped, integral and unitary plastic structural material in accordance with a novel method also described hereinafter or, if so desired and, if expedient to do so, one or more of the sections can be formed in a different manner by a different method.

Figure 11:
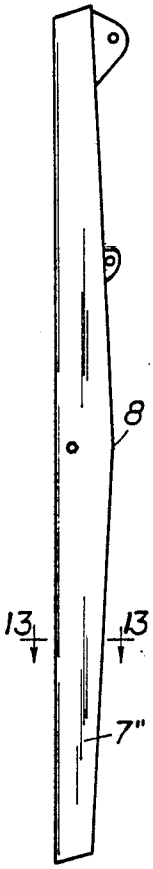
FIG. 11 is a right side elevational view of FIG. 10, the opposite side being a mirror image thereof.

Front and rear sections 3 and 4 as disclosed each include spaced opposed longitudinally extending side member pairs 6 and 7. As can be seen in the cross-sectional views of FIGS. 7 and 13, side members of pairs 6 and side members of pairs 7 respectively are each of substantially U-shaped cross-section throughout to provide longitudinally extending base legs 6′ and 7′ respectively, each having spaced opposed side legs 6″ and 7″ respectively extending therefrom with the opposed open ends of opposed U-shaped side members of opposed ladder sections 3 and 4 facing each other. It is to be noted in FIGS. 3 and 11 that the side legs 7″ of side members 7 of rear ladder section 4 are each of tapered breadth with the greatest breadth of the side leg 7″ as at point 8 being substantially in the middle and intermediate the extremities of the side leg 7″. This feature serves to strengthen the side members 7 and to permit preselected face-to-face collapsing of opposed ladder sections 3 and 4 for compact transport and storage of the folded ladder 2. This feature further serves to space the upper platform sections when the platform is in collapsed position for carrying and storage and to avoid finger pinching during ladder erection. It is further to be noted in FIGS. 6 and 12 that both U-shaped side members 6 of the side member pair of front ladder section 3 and U-shaped side member 7 of the side member pair of rear ladder section 4 are provided with spaced sets of truss member 11 and 12 respectively. The truss members of these sets extend transversely between the opposed legs of each side member for additional structural strength and, as will be discussed more fully hereinafter, the middle truss members of each set also are used as stop members. Also, it is to be noted in FIGS. 1, 4, 6, 10 and 12, that suitable bracing struts 10 and 20 can be provided at the base of the side members of each ladder section 3 and 4 respectively to strengthen base support of the ladder sections.

As can be seen in FIGS. 1, 4 and 6 and FIGS. 10 and 12, the opposed front and rear ladder sections 3 and 4 each include a set of spaced cross-braces 13 and 14 respectively of generally U-shaped cross-section connectively extending longitudinally between and normal to the inner legs of the pairs of U-shaped side members 6 and 7 respectively. The cross-braces 13, each of which includes longitudinally extending outside facing base leg 13′ and integral, inwardly extending spaced side legs 13″ (as disclosed in FIG. 16) are in the form of spaced steps (FIG. 4) with the upper faces of the upper side legs 13″ thereof so positioned relative the spaced pair of side members 6 as to be horizontally oriented when foldable ladder 2 is in erected position. In this regard, it is to be noted that the lengths of the spaced sets of cross-brace members 13 and 14 increase from top toward bottom of the ladder sections so that side members 6 and 7 taper outwardly from top toward bottom, the amount of tapering and spacing conforming with existing ladder code requirements. It also is to be noted in FIG. 17 that the generally U-shaped cross-brace members 14 of the rear ladder section, each of which is disclosed to include longitudinally extending outside facing base leg 14′ and integrally inwardly extending spaced side legs 14″, could be, if desired, formed in a manner similar to cross-brace members 13 to provide upper step portions.

Figure 4:
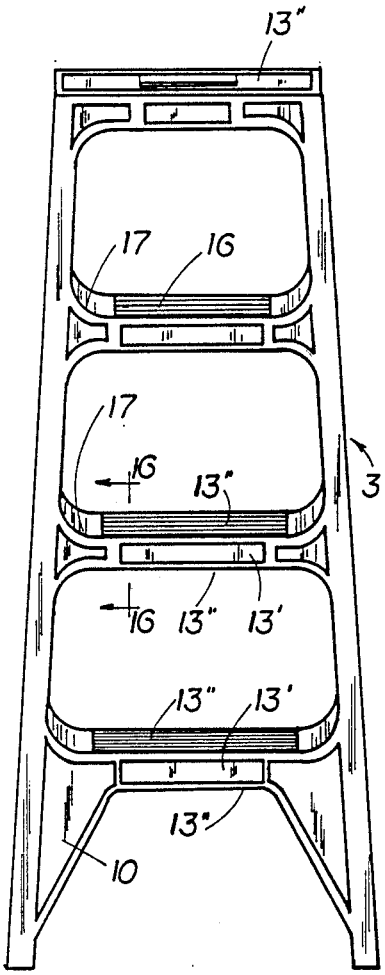
FIG. 4 is an outside or front elevational view of the front section of the foldable ladder.
Figure 5:
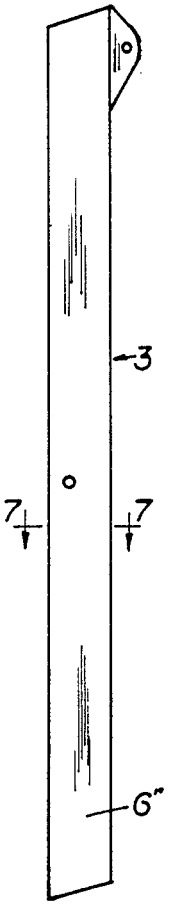
FIG. 5 is a right side elevational view of FIG. 4, the opposite side being a mirror image thereof.
Figure 16:
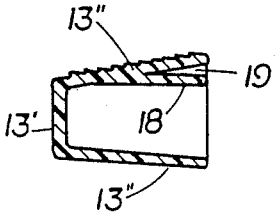
FIG. 16 is an enlarged cross-sectional view taking in a plane through line 16—16 of FIG. 4, disclosing details of one of the generally U-shaped cross-braces serving as steps in the ladder front section including the tread and the reinforced upper leg portion of such a step.
Figure 17:
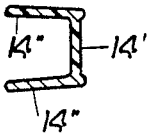
FIG. 17 is an enlarged cross-sectional view taken in a plane through line 17—17 of FIG. 12, disclosing details of the generally U-shaped cross-brace of the ladder rear section.

In this regard, referring to FIGS. 4 and 16, it can be seen that the upper side legs 13′ have a tread surface thereon of spaced, longitudinally extending serrations 16 of triangular cross-section to define a relatively sharp gripping edge at the upper portion thereof. In the embodiment disclosed, it is to be noted that one side of each serration slopes inwardly downward from front to back relative the step face and that the other side of each serration is normal to the step face. It also is to be noted that each of the U-shaped brace members 13 and 14 have the spaced side legs thereof tapering slightly outward from the respective base legs. The reasons for such contour of serrations and the tapering of brace members will be discussed more fully hereinafter. Further, in FIGS. 1, 4 and 6, it is to be noted that the upper side legs 13'' of each cross-brace member 13 that serves as a step is curved upwardly at the longitudinal extremities thereof as indicated by reference numeral 17 to insure step usage by a ladder user along the central portion thereof to inhibit tipping. And, in FIGS. 6 and 16 it can be seen that each upper side leg 13'' of cross-brace 13 which serves as a step has increased structural support strength from front to rear to resist downward deflection of the rear portion under force placed thereon. This is accomplished through an upper undersupport leg 18 extending outwardly from base leg 13' with spaced tapered intermediate truss members 19 extending transversely between upper side leg 13'' and undersupport leg 18.

Referring to FIGS. 2, 3, 5, 6 and 8, it can be seen that front ladder section 3 is provided with sets of spaced, apertured leaf members 21 extending inwardly from front to rear of section 3 along the upper cross-brace 13. In like fashion and referring to FIGS. 1, 2, 3 and 10–15, it can be seen that rear ladder section 4 is provided with sets of spaced, apertured leaf members 22 extending inwardly from front to rear of section 4 along the upper cross-brace 14. These leafsets 21 and 22 serve as trusses for the upper cross-braces 13 and 14 and the sets are laterally offset relative one another to permit dovetailing of their opposed apertured extensions to form an upper hinge for the front and rear sections 3 and 4 when a suitable hinge pin 23 is inserted therethrough with the upper side legs 13'' and 14'' serving as spaced top ladder platforms. The laterally offset leaves further permit assembly of one type of the sections such as front step section 3, for both front and rear of ladder assembly. It is to be understood that in addition to leaf member sets 21 and 22, further suitable structural truss members can be provided between the side legs of each of the cross-braces 13 and 14 as might be needed. Although several such additional structural truss members are shown in several figures of the drawings, details of these additional truss members are not described herein.

Figure 6:
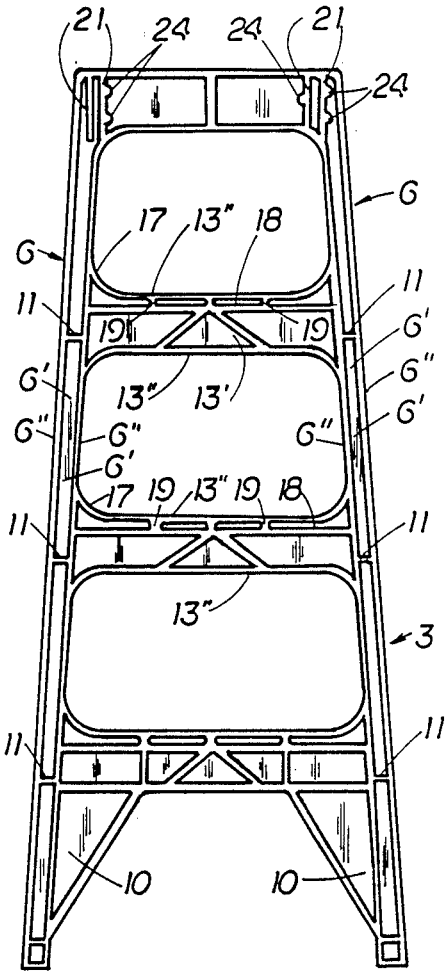
FIG. 6 is an inside or rear elevational view of the front section of the foldable ladder.
Figure 8:
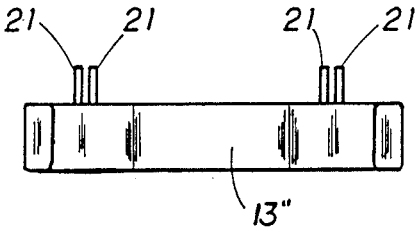
FIG. 8 is a bottom plan view of the front section of the foldable ladder.
Figure 7:
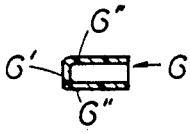
FIG. 7 is an enlarged cross-sectional view taken through line 7—7 of FIG. 5.
Figure 9:
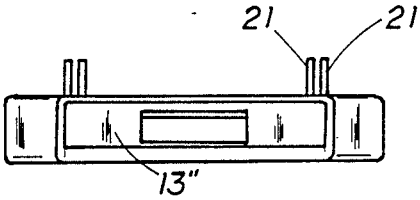
FIG. 9 is a top plan view of the front section of the foldable ladder.
Figure 10:
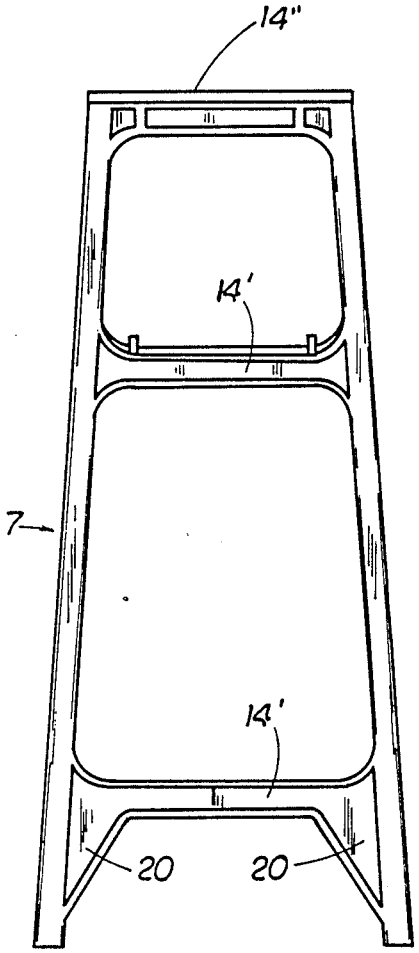
FIG. 10 is an outside or front elevational view of the rear section of the foldable ladder.

Referring to the top portion of front ladder section 3 in FIG. 6 of the drawings, it is to be noted that certain of the spaced leaves of set 21 are provided with raised ribs 24 along the sides thereof. Ribs 24 are spaced and positioned to serve as stops for the leading edges of the set of dovetailing leaves 24 to assure that in hinge assembly of ladder sections 3 and 4, the dovetailing sets of leaves have their apertures appropriately aligned for expedient insertion of hinge pin 23.

Figure 19:
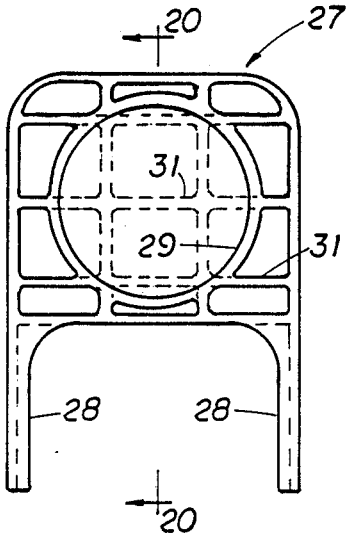
FIG. 19 is an enlarged top plan view of the shelf section disclosed in FIGS. 1–3.
Figure 20:
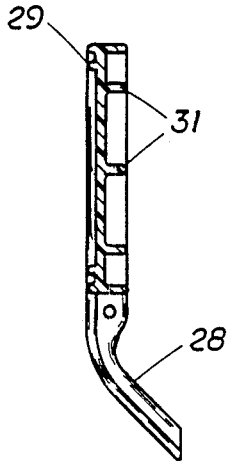
FIG. 20 is a cross-sectional view of the shelf section taken in a plane through line 20—20 of FIG. 19.
Figure 12:
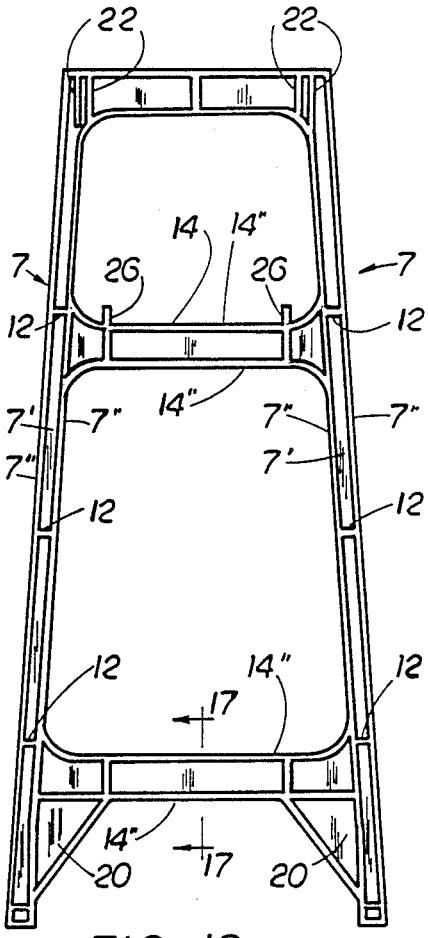
FIG. 12 is an inside or rear elevational view of the rear section of the foldable ladder.
Figure 14:
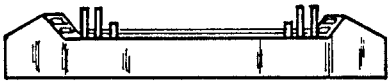
FIG. 14 is a top plan view of the rear section of the foldable ladder.
Figure 13:
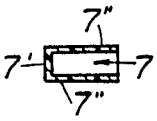
FIG. 13 is a cross-sectional view taken through line 13—13 of FIG. 11.
Figure 15:
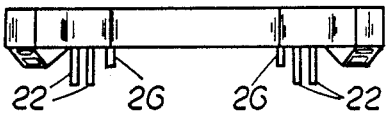
FIG. 15 is a bottom plan view of the rear section of the foldable ladder.

Referring to FIG. 12 of the drawings, it can be seen that the intermediate cross-brace member 14, has its trusses between spaced side legs 14''—14'' extended to provide spaced apertured cantilevered support leaves 26. These support leaves 26 serve to pivotally support shelf member 27 which can be manually extended in erected horizontal support position when front and rear ladder sections 3 and 4 respectively have been moved from collapsed to erected position with their upper portions in proximal relation and their lower portions in distal relation. Shelf member 27, as disclosed in FIGS. 19 and 20, includes means cooperable with one of the ladder sections to pivotally collapse the shelf when front and rear ladder sections 3 and 4 are pivoted to collapsed position. This is accomplished by means of a pair of spaced curved arm members 28 integrally extending from the main body of shelf 27. When the shelf 27 is properly assembled to pivot on cantilevered leaves 26 of cross-brace 14, the arms 28, which are of appropriate length and appropriately curved, abut an edge of an opposed cross-brace 13 in the front ladder section 3 to be pivotally cammed to collapsed position within front section 3 and rear section 4 when these sections are moved to collapsed position (FIG. 3). It is to be noted in FIG. 19 that shelf 27 is provided with a circular raised rib 29 on its upper surface to receive a material container (not shown) and inhibit its lateral movement on the shelf top. Shelf 27 is further provided on both upper and lower surfaces with a series of spaced and crossed truss ribs 31 to increase the support strength and stability of the shelf.

Figure 18:
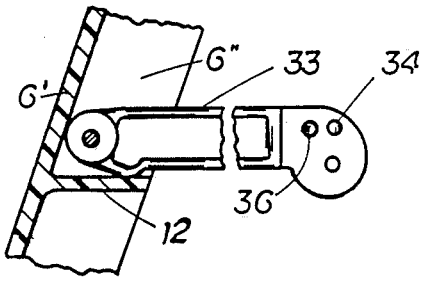
FIG. 18 is an enlarged broken away segmental view of portions of a link arm of a spreader assembly and a portion of a U-shaped side member of a ladder, disclosing one end of the link arm in abutting engagement with a truss which extends transverse the legs of the side member (see FIG. 6) and the opposite end of the link arm with the detent and recess thereon.

To limit outward pivotal movement of front and rear ladder sections 3 and 4, a collapsible spreader assembly 32 (FIGS. 1 and 2) is interposed between the pivotally hinged sections in spaced relation from the top platform sections with the extremities of the assembly connected to each of the sections. Assembly 32 includes spaced sets of link arm pairs, the link arms 33 of each pair are pivotally connected together in end-to-end relation with the opposite ends of the connected pairs nesting in the open ends of opposed U-shaped side members 6 and 7 of opposed pivotally hinged, ladder sections 3 and 4 which face each other. Each of such opposed nesting ends are pivotally mounted between the opposed longitudinally extending side legs 6'' and 7'' of the opposed side members 6 and 7 immediately above one of the trusses of truss sets 11 and 12. As can be seen in FIG. 18, each link arm 33 is so positioned relative the adjacent truss to abut and be stopped by the same when the link arm is pivoted to spread position. As can also be seen in FIG. 18, the inner face at the opposite extremity of each link arm 33 is provided with a raised detent 34 and a recess 36, the detent and recess being alternatively positioned on facing arm extremities to interlock and further restrain the pivoted link arms when in extended position.

It is to be understood that suitable treads or shoes (not shown) can be fastened to the bottoms of front ladder section 3 and rear ladder section 4, side members 6 and 7 respectively to prevent the ladder assembly from slipping. Further, although not shown, it would be possible to provide suitable linkage with ladder structure 2 to automatically move shelf 27 to a horizontal support position when front and rear ladder sections 3 and 4 are pivoted to erected position.

Figure 21:
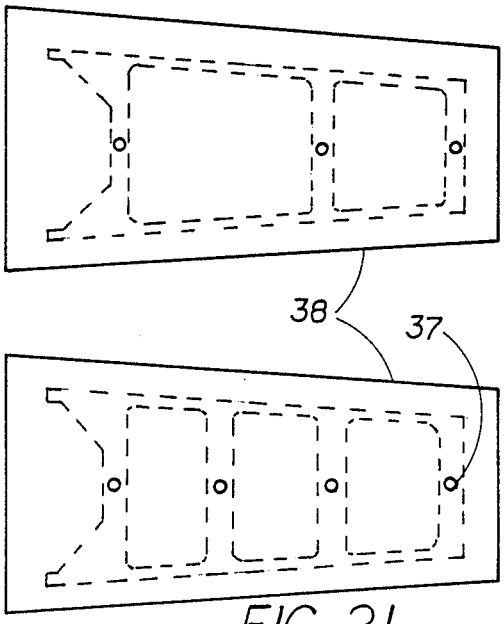
FIG. 21 is a schematic plan view of bottom portions of mold members which can be utilized to carry out the inventive method of forming front and rear ladder sections; and, FIG. 22 is a schematic side view of one of such mold members with a nozzle set associated therewith.
Figure 22:
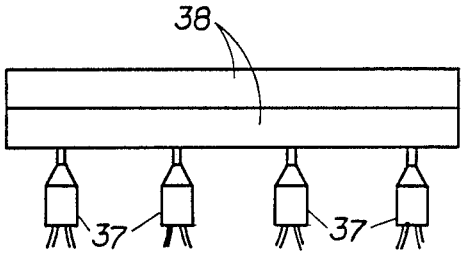

Referring to FIGS. 21 and 22 of the drawings, these figures schematically disclose mold apparatus for carrying out the steps of a novel method of manufacturing the unique apparatus described. In accordance with this novel method, controlled quantities of a suitable thermoplastic or possibly even a suitable thermosetting plastic compound which, when at an appropriate temperature for the particular plastic compound selected has a liquid or flowable form can, be introduced in unexpanded form by injection through the nozzles of spaced plastic storage containers 37 at preselected spaced stations along several mating pairs of first and second mold parts 38, these mold parts being shaped and appropriately dovetailed in spaced relation to define first and second ladder sections of the shape of front and rear ladder sections 3 and 4 including the U-shaped side and cross-brace channel members and the hinge leaf sets and cantilevered leaf members as above described. In carrying out the inventive process, the mating pairs of molds would further include (not shown) a mold pair which defines a shelf section with cantilevered integral curved arms extending therefrom, another two of which define link arms having apertures, recesses and detents as abovedescribed and, if desired, mold pairs defining male and female rivet parts such as can be seen in U.S. Pat. No. 3,208,331, issued to H. O. Scholl on Sept. 28, 1986. Once appropriate quantities of expansible plastic material have been introduced into the several pairs of mold parts, the injected plastic compounds are expanded to their respective limits of confinement. After the expanded compounds have been allowed to set, the finished sections can be released from their respective mold pairs and the several finished parts can be assembled into a compact, foldable plastic ladder as abovedescribed.

It is to be understood that although plastic rivets can be utilized as pivot members for the dovetailed hinges, the shelf and the link-arm spreader mechanism to avoid any possible electrical conductivity, it also would be possible to utilize suitable low electrically conductive metallic materials in such pivot places since they would be electrically insulated by the surrounding plastic parts which are assembled together. It also is to be understood that any one of a number of known plastic materials can be satisfactorily used to form the several parts abovedescribed. Advantageously the material should be a thermoplastic one capable of softening and expanding at preselected temperatures to permit changes in shape and capable of hardening in such changed shape to maintain such shape at expected ambient temperatures.

The invention claimed is:

1. Foldable ladder structure comprising: opposed front and rear ladder sections, each including a pair of spaced longitudinally extending side members with spaced cross-brace means connectively extending therebetween, with the uppermost brace means of both sections being laterally aligned and in the same horizontal plane when said ladder sections are in erected position to form a spaced top platform and with the lower brace means of at least one section being in the form of steps, said brace means extending substantially normal to and connected to said spaced side members, at least one of said ladder sections with its uppermost brace means being formed from a shaped, integral and unitary structural material; and, opposed hinge means fixed to said opposed ladder sections including dovetailing sets of spaced, apertured leaf members, said uppermost brace means forming the top platforms each being of a substantially U-shaped cross section throughout to include a laterally extending base member with spaced opposed laterally extending upper and lower leg members extending therefrom and having an open end, said sets of spaced, apertured leaf members extending between and abutting said leg members to form a truss support of said top platform with the leaf member set of at least one section being an integrally formed portion thereof and with both sets of leaf members projecting in cantilever lateral fashion from said open ends of their respective sections toward the opposite section so as to dovetail with each other and be joined in hinged pivotal relation along a pivotal axis extending intermediate said front and rear ladder sections pivotally connecting said front and rear ladder sections together at the upper portions thereof in symmetrical relation, so that said sections can be pivoted relative each other from collapsed face-to-face relation to erected symmetrical position with the upper portions in proximal relation and the lower portions is spaced distal relation.

2. The foldable ladder structure of claim 1, and collapsible spreader means interposed between said pivotally hinged front and rear sections in spaced relation below the upper portions thereof and connected to said sections to limit outward pivotal movement of said sections.

3. The foldable ladder structure of claim 1, and a shelf member pivotally mounted to one of said ladder sections at the upper portion thereof to be extended in erected horizontal support position when said ladder sections are in erected position, said shelf member having means cooperable therewith to pivotally collapse said shelf member when said ladder sections are pivoted to collapsed position.

4. The foldable ladder structure of claim 1, said steps having at least the upper portions curved upwardly at the extremities connected to said spaced side members to insure step usage along the central portion thereof to inhibit ladder tipping.

5. The foldable ladder structure of claim 1, the cross-brace means of each ladder section being in the form of a portion of the top platform and spaced steps.

6. The foldable ladder structure of claim 1, both of said sections being formed from a shaped, integral and unitary structural material.

7. The foldable ladder structure of claim 1, said shaped, integral and unitary structural material being a plastic material.

8. The foldable ladder structure of claim 1, each of the spaced longitudinally extending side members of at least one section being of tapered breadth with the greatest breadth being intermediate its extremities to provide for strengthening and to permit preselected face-to-face collapsing of opposed sections for compact storage and grip spacing intermediate the top portions thereof when said ladder is in erected position.

9. The foldable ladder structure of claim 1, said spaced leaf members of one section being lineally offset from spaced leaf members of the opposite section to permit dovetailing of opposed leaf members for hinging purposes and interchangeability of ladder sections.

10. The foldable ladder structure of claim 1, said spaced leaves of one set being lineally offset a preselected distance from spaced leaves of the opposite set to permit adjacent dovetailing of opposed leaves for hinging purposes, the spaced leaves of one set having step means thereon to stop adjacent leaves of the other set when the respective apertures thereof are aligned for hinge assembly purposes.

11. The foldable ladder structure of claim 1, and collapsible spreader means interposed between and pivotally connected to said pivotally hinged front and rear sections in spaced relation below the upper portions thereof, said spreader means including at least one set of link arms having end portions pivotally connected together in end-to-end relation, said connected end portions including a raised detent on one end portion sized and positioned to engage in an appropriately sized recess on the other end portion to hold the link arms in locked position when said front and rear ladder sections are moved to extended position.

12. The foldable ladder structure of claim 1, and a shelf member pivotally mounted to one of said ladder sections at the upper portion thereof to be extended in erected horizontal support position when said ladder sections are in erected position, said shelf member having at least one arm member extending therefrom in cantilever fashion toward said other ladder section, said arm member being sized and positioned to abut said cross-brace means of said other ladder section in camming relation to pivotally collapse said shelf member when said ladder sections are pivoted to collapsed position.

13. The foldable ladder structure of claim 1, each of said pairs of spaced, longitudinally extending side members of each ladder section having a substantially U-shaped cross-section throughout to include a longitudinally extending base member with spaced opposed longitudinally extending leg members extending therefrom, and spaced truss members extending transversely between said opposed leg members of each side member for structural strength.

14. The foldable ladder structure of claim 1, each of said pairs of spaced longitudinally extending side members of each ladder section having a substantially U-shaped cross-section throughout to include a longitudinally extending base member with spaced opposed longitudinally extending leg members extending therefrom, the open ends of opposed side members of opposed ladder sections facing each other, said U-shaped side members each including spaced truss members extending transversely between said opposed leg members of each side member for structural strength; and, collapsible spreader means interposed between and pivotally connected to said pivotally hinged front and rear sections in spaced relation below the upper portions thereof, said spreader means including spaced sets of link arm pairs pivotally connected together in end-to-end relation with the opposite ends of said link arm pairs nesting in the open ends of opposed U-shaped side members of opposed ladder sections facing each other, each of such opposed link arm ends being pivotally mounted between the opposed longitudinaly extending side legs of such side members above a spaced truss member extending therebetween to abut said truss member and be stopped thereby when said ladder sections are pivoted to erected position.

15. The foldable ladder structure of claim 1, said hinge means for pivotally connecting said front and rear sections together including dovetailing sets of spaced, apertured leaf members extending from the upper portion of each of said front and rear ladder sections with spaced leaf members of one section being lineally offset from spaced leaf members of the opposite section to permit dovetailing of opposed leaf members for hinging purposes and interchangeability of ladder sections, certain of said leaf members serving as transverse truss members for said U-shaped cross-brace means.

16. The foldable ladder structure of claim 1, and comprising a shelf member pivotally mounted to one of said cross-brace members of one of said ladder sections at the upper portion thereof to be extended in erected horizontal support position when said ladder sections are in erected position, certain of said transverse truss members for said cross-brace members to which said shelf is pivotally mounted including spaced cantilevered apertured leaf portions from which said shelf member is pivotally mounted.

17. The foldable ladder structure of claim 1, at least one of said ladder sections including bracing struts extending from the base of said pair of spaced longitudinally extending side members to said cross-brace means to strengthen support at the base of said ladder section.

18. The foldable ladder structure of claim 1, at least one of said spaced steps having a tread surface thereon of spaced, laterally extending serrations of triangular cross-section to define a relatively sharp gripping edge at the upper portion thereof.

19. The foldable ladder structure of claim 1, said section having the brace means in the form of spaced steps being of molded plastic material, at least one of said spaced steps having a tread upper surface thereon of spaced, laterally extending serrations of right-triangular cross-section with one side of each serration sloping inwardly downward relative to the step face and the other being normal thereto to define relatively sharp gripping edges along the upper surface and to permit mold release.

20. The foldable ladder structure of claim 1, at least one of said spaced steps having a spaced coextending sandwiched undersupport leg member extending in spaced relation below the upper surface of said step and above the lower surface of said step, with spaced tapered transverse truss members extending therebetween thereby increasing structural support strength from front to rear to resist downward deflection of the rear portion under force placed thereon.

21. The foldable ladder structure of claim 1, said section having the brace means in the form of spaced steps being of molded plastic material of generally U-shaped cross-section to include a laterally extending base member positioned at the front of said ladder section and laterally extending spaced upper and lower leg members tapering outwardly from said front base member toward said opposite ladder section to permit mold release, said upper leg member including an undersupport leg member with spaced tapered intermediate truss members extending therebetween whereby said upper leg member has increased structural strength from front to rear to resist downward deflection of the rear portion under standing weight placed thereon.

22. Foldable ladder structure comprising opposed front and rear ladder sections, each being formed from a shaped, integral and unitary thermoplastic structural material to include a pair of spaced longitudinally extending side members having a substantially U-shaped cross-section throughout providing a longitudinally extending base member with spaced opposed longitudinally extending leg members extending therefrom, the leg members of said side members of said rear section each being of tapered breadth with the greatest breadth being intermediate its extremities to provide for strengthening and to permit preselected face-to-face collapsing of opposed sections for compact storage and finger grip spacing intermediate the top portions thereof when said ladder is in collapsed position for carrying and to avoid pinching in erection, the open ends of opposed side members of opposed ladder sections facing each other, said U-shaped side members each including spaced truss members extending transversely between said opposed leg members of each side member for structural strength, said opposed front and rear ladder sections further including cross-brace means connectively extending between said side members with the cross-brace means of both said front and rear sections being in the form of a top platform and the remainder of the cross-brace means of said front section forming spaced steps extending substantially normal to and connected to said spaced side members with the upper portions of said spaced steps in said front section curved upwardly at the extremities and connected to said spaced side members to insure step usage along the central portion thereof to inhibit tipping, said central portions having raised anti-skid serrations, said cross-brace means of each ladder section each being of substantially U-shaped cross-section throughout to include a laterally extending base member with spaced opposed laterally extending upper and lower leg members extending therefrom, and having an open end, said open ends of opposed cross-brace members of opposed ladder sections facing each other, said U-shaped cross-brace means each including spaced truss members extending transversely between said opposed leg members of each cross-brace member for structural strength;

both of said ladder sections including bracing struts extending from the base of each side member of each of said pairs of side members to a proximate lower most cross-brace means to strengthen support at the base of said ladder section;

hinge means for pivotally connecting said front and rear ladder sections together at the upper portions thereof so that said sections can be pivoted relative to each other from collapsed face-to-face relation to erected position with the upper portions in proximal relation and the lower portions in spaced distal relation, said hinge means including dovetailing sets of spaced, apertured leaf members, both sets of leaf members projecting in a cantilever lateral fashion from said open ends of their respective sections towards the opposite section, and extending integrally from the upper portion of each of said front and rear ladder sections with spaced leaf member sets of one section being lineally offset from spaced leaf member sets of the opposite section to permit dovetailing of opposed leaves of leaf member sets for hinging purposes and interchangeability of ladder sections, a portion of certain of said leaf members serving as transverse truss members for said U-shaped cross-brace means forming said top platform and certain of said leaf members of one set having raised stop means thereon to stop adjacent leaf members of the other set when the respective apertures thereof are aligned for hinge pin assembly purposes;

collapsible spreader means interposed between and pivotally connected to said front and rear sections in spaced relation below the upper hinged portions thereof to limit outward pivotal movement thereof, said spreader means including spaced sets of link arm pairs formed from a shaped, integral and unitary thermoplastic structural material, said plastic arm pairs being pivotally connected together in end-to-end relation, said connected end portion including a raised detent on one end portion sized and positioned to engage in an appropriately sized recess on the other end portion to hold said link arms of a pair in locked position when said front and rear ladder sections are moved to extended position, the opposite ends of said link arm pairs nesting in the open ends of opposed U-shaped side members of opposed ladder sections facing each other, each of such opposed ends of each of said link pairs being pivotally mounted between opposed longitudinally extending leg members of said side members above a spaced truss member extending therebetween to abut said truss member and be stopped thereby when said ladder sections are pivoted to erected position and said raised detent on one end portion of said end-to-end connected link arms engages with said recess on an adjacent end portion; and, a shelf member formed from a shaped, integral and unitary thermoplastic material to include a raised circular portion on the upper surface thereof to receive and retain the bottom of a cylindrical material container and cross-truss members on the lower surface thereof for structural strength, said shelf member being pivotally mounted to an upper cross-brace of said rear ladder section at the upper portion thereof to be extended in erected horizontal support position when said ladder sections are in spread erected position, certain of said transverse truss members for said upper cross-brace to which said shelf is pivotally mounted including spaced cantilevered leaf portions between which opposed shelf sides are pivotally mounted, said shelf having a pair of spaced curved arm members integrally extending therefrom toward said stepped front ladder section, said arms being sized to abut an edge of an opposed step of said front section in camming relation to pivotally collapse said shelf member within said sections when said front and rear ladder sections are pivoted to collapsed position.

* * * * *

UNITED STATES PATENT AND TRADEMARK OFFICE

CERTIFICATE OF CORRECTION

PATENT NO. : 4,834,216

DATED : May 30, 1989

INVENTOR(S) : Claude R. Wallick, Jr. and Thomas J. Schmitt

It is certified that error appears in the above-identified patent and that said Letters Patent is hereby corrected as shown below:

Column 1, line 16, "spreakder" should be ---spreader---.

Column 1, line 46, "May 22, 1986" should be ---May 22 1906---.

Column 7, line 17, "September 28, 1986" should be ---September 28, 1965---.

Column 9, line 50, "longitudinaly" should be ---longitudinally ---.

Signed and Sealed this

Twenty-seventh Day of March, 1990

*Attest:*

JEFFREY M. SAMUELS

*Attesting Officer*

*Acting Commissioner of Patents and Trademarks*